US005136852A

United States Patent [19]

Neeser et al.

[11] Patent Number: 5,136,852

[45] Date of Patent: Aug. 11, 1992

[54] CONTROL REGULATOR AND DELIVERY SYSTEM FOR A CRYOGENIC VESSEL

[75] Inventors: Timothy A. Neeser, Savage; Peter L. Bliss, Prior Lake, both of Minn.

[73] Assignee: Minnesota Valley Engineering, Inc., New Prague, Minn.

[21] Appl. No.: 683,267

[22] Filed: Apr. 10, 1991

[51] Int. Cl.[5] ..... F17C 9/04

[52] U.S. Cl. ..... 62/50.4; 62/51.1

[58] Field of Search ..... 62/50.4, 51.1

[56] References Cited

U.S. PATENT DOCUMENTS

| | | | |
|---|---|---|---|
| 2,964,919 | 12/1960 | Howlett | 62/50.4 |
| 3,001,375 | 9/1961 | Tauscher | 62/50.4 |
| 3,046,751 | 7/1962 | Gardner | 62/50.4 |
| 3,070,968 | 1/1963 | Gardner | 62/50.4 |
| 3,097,497 | 7/1963 | Fitt | 62/50.4 |
| 3,195,317 | 7/1965 | Mientus | 62/50.4 |
| 3,304,739 | 2/1967 | Erath | 62/50.4 |

FOREIGN PATENT DOCUMENTS 846799 8/1960 United Kingdom .

*Primary Examiner*—Ronald C. Capossela
*Attorney, Agent, or Firm*—Rockey and Rifkin

[57] ABSTRACT

The regulator of the invention includes a pressure builder inlet, economizer outlet and a pressure builder outlet/economizer inlet. A valve is moved in response to the pressure of the gas head in the tank to connect the pressure builder outlet/economizer inlet with either the pressure builder inlet or economizer outlet. As a result, the single dual-function regulator of the invention allows gas to be delivered from either the gas head or the liquid body as determined by the pressure of the gas head. A manual pressure build up valve is provided to allow isolation of the pressure build up system.

15 Claims, 4 Drawing Sheets 31
60
69
67
65
63
73
71
74
89
76
61
75
37
VAPORIZER LINE
95
93
77
79
91
87
85
81
81a
113
83
111
110
107a
33
92
ECONOMIZER LINE
35
PRESSURE BUILDER LINE
103
99
107
101
105

CONTROL REGULATOR AND DELIVERY SYSTEM FOR A CRYOGENIC VESSEL

BACKGROUND OF THE INVENTION

The invention relates, generally, to cryogenic vessels and, more particularly, to an improved control regulator and delivery system therefore.

Cryogenic vessels typically consist of an insulated double-walled tank for storing fluids such as liquid oxygen nitrogen or argon at very low temperatures. The fluid is stored in the tank as a liquid and is dispensed therefrom and used as a gas. For example, liquid oxygen can be dispensed from the tank in a gaseous state for use in medical or industrial applications.

While the cryogenic vessel is insulated, it is impossible to prevent all heat transfer between the interior of the tank and the external environment. As a result, the oxygen, although introduced into the tank in a liquid state, will slowly but continuously vaporize creating a gaseous head of oxygen above the liquid body.

Because the oxygen is used in a gaseous state, it is advantageous to use this head gas before vaporizing the liquid supply. If the head gas were not used it would eventually have to be vented from the tank to maintain the tank's internal pressure. Therefore, by using the head gas first, the waste of oxygen resulting from the venting procedure is eliminated.

One problem with supplying the oxygen directly from the head is that the head pressure will not always be sufficient to meet use requirements. When the head pressure is insufficient, the liquid body must be vaporized to meet the use requirements and to rebuild the head pressure.

To coordinate the supply of oxygen from the gas head and liquid body, a relatively complex delivery system has been developed. The known delivery system is illustrated in FIGS. 1 and 2 and consists of a double-walled cryogenic storage tank 1 holding a supply of fluid, for example, liquid oxygen, shown at 2. A gaseous head 3 of vaporized oxygen will form due to the transfer of heat between the interior of the tank and the external environment. A fluid supply line 5, having a control valve 7, is provided for delivering liquid oxygen to tank 1.

To dispense the liquid oxygen from the tank for use, a pressure building coil 9 is connected to the bottom of tank 1. The liquid oxygen is free to flow from tank 1 into coil 9. Because pressure building coil 9 is disposed relatively close to the exterior of tank 1, heat transfer between the external environment and the liquid in coil 9 will be relatively great. As a result, the liquid oxygen will be vaporized such that the pressure in coil 9 will build. Coil 9 is connected to pressure building line 8 which includes a pressure building regulator 13, a pressure building valve 11 and a return line 23 the functions of which will be hereinafter described.

A vaporizer line 10 connects pressure building line 8 to vaporizer 17 and includes an economizer regulator 15. Vaporizer 17 is connected to gas use line 19 and is disposed closely adjacent to the external wall of tank 1 such that heat transfer in vaporizer 17 will be great enough to vaporize any remaining liquid oxygen before it is delivered to gas use line 19. Gas use line 19 includes a gas use valve 21 for controlling the delivery of gas for its intended use.

Return line 23 connects the gas head 3 in tank 1 to the pressure building line 8 and vaporizer line 10. Finally, a vent system 24 is connected to pressure building line 8 and vaporizer line 10 and consists of a vent valve 25, pressure gauge 26, and pressure control valve 27. Gas can be vented from the tank 1 when the pressure of head 3 rises above a predetermined limit. Burst disc 28 ensures that under extreme conditions tank 1 and the other components will not be damaged from an abnormally large pressure build up.

To describe operation of this system, assume that a supply of liquid oxygen 2 is in tank 1 and that a gas head 3 has formed. Also assume that the pressure in the system is lower than the predetermined value set by pressure control valve 27 such that no gas is being vented from the system.

To dispense oxygen gas, gas use valve 21 is opened and head gas is delivered via use line 19. As long as the pressure of head 3 is sufficiently great, i.e. above the value set at economizer regulator 15, pressure building regulator 13 will be closed such that gas is provided directly from head 3 through economizer line 23 to vaporizer line 10. From vaporizer line 10 the gas passes through vaporizer 17 and is delivered for use from gas use line 19.

If the pressure of head 3 falls below the predetermined value set at economizer regulator 15, pressure building regulator 13 will open such that liquid oxygen is removed from the bottom of tank 3 and enters pressure building (vaporizer) coil 9 where it is vaporized and delivered to pressure building line 8. Note, pressure building regulator 13 is generally set at a pressure slightly below economizer regulator 15 so that the two are related, but not overlapping. If valve 11 is open, gas will flow to the junction 20 of pressure building valve 13, economizer valve 15 and return line 23. Because economizer valve 15 is closed, gas will enter head space 3 via line 23 to build and maintain tank pressure.

To supply oxygen gas at valve 21 when the head pressure is lower than the setting of economizer regulator 15, liquid oxygen is withdrawn from tube 5 and enters vaporizer coil 17. The liquid oxygen is converted to gaseous oxygen and delivered to valve 21 via use line 19.

While this system allows the gas to be taken from the head 3 as long as there is sufficient head pressure, it requires two regulators and relatively complicated plumbing, as best shown in FIG. 2. As a result this system is expensive to manufacture and maintain.

Thus, a delivery system for a cryogenic vessel that is of a simple design and is relatively inexpensive to manufacture and maintain is desired.

SUMMARY OF THE INVENTION

The delivery system of the invention replaces the economizer regulator and pressure building regulator of the prior art system with a single regulator that performs both functions. By eliminating a regulator, the plumbing required for the present invention is also greatly simplified. As a result, a cryogenic vessel employing the delivery system of the present invention is of a simple design that is relatively inexpensive to manufacture and maintain.

The regulator of the invention includes a pressure builder inlet, economizer outlet and a pressure builder outlet/economizer inlet. A valve operates in response to the pressure in the system to connect the pressure builder outlet/economizer inlet with (1) either the pressure builder inlet or (2) the economizer outlet. As a result, the single dual-function regulator of the invention allows gas to be delivered from either the gas head or the liquid body as determined by the pressure in the system. A manual pressure build up valve is provided to allow the buildup of pressure in the system.

OBJECTS OF THE INVENTION

It is a general object of the invention to provide an improved cryogenic vessel having a simplified delivery system.

It is another object of the invention to replace the pressure building regulator and economizer regulator of the prior art with a single dual-function regulator.

It is a further object of the invention to provide an improved cryogenic vessel that is simple and inexpensive to manufacture and maintain.

Other objects of the invention, in addition to those set forth above, will become apparent to one of ordinary skill in the art from the following detailed description of the invention.

DETAILED DESCRIPTION OF THE INVENTION

Figure 3A:
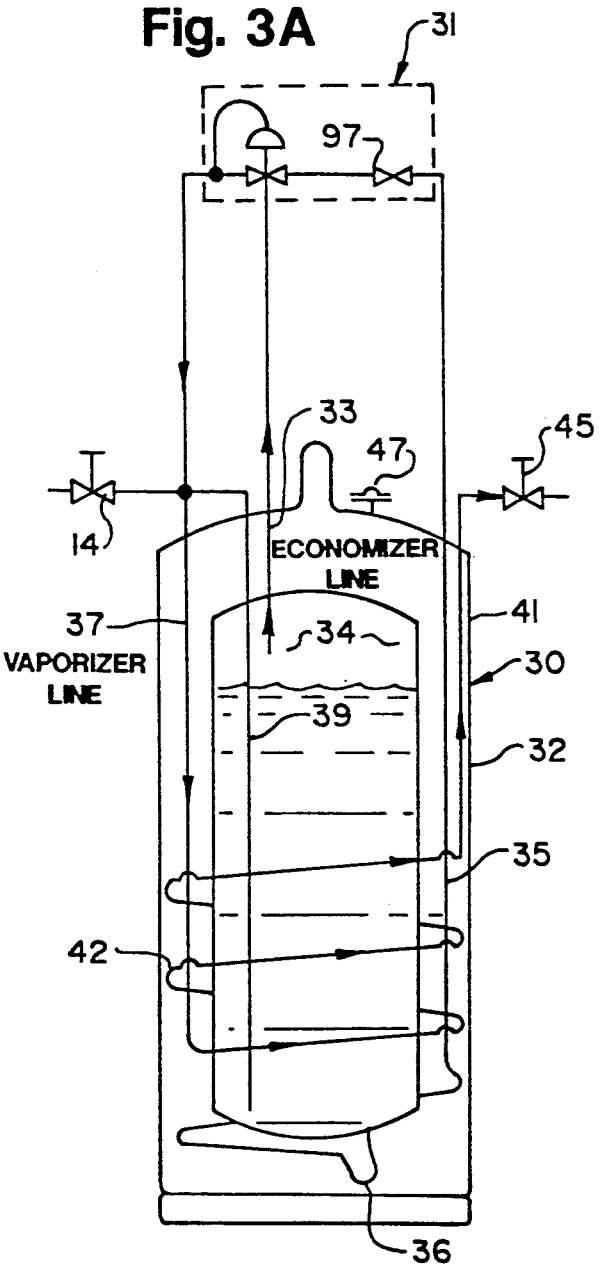
FIG. 3A is a schematic view of the delivery system of the invention showing the operation of the system delivering gas from the gas head.
Figure 3B:
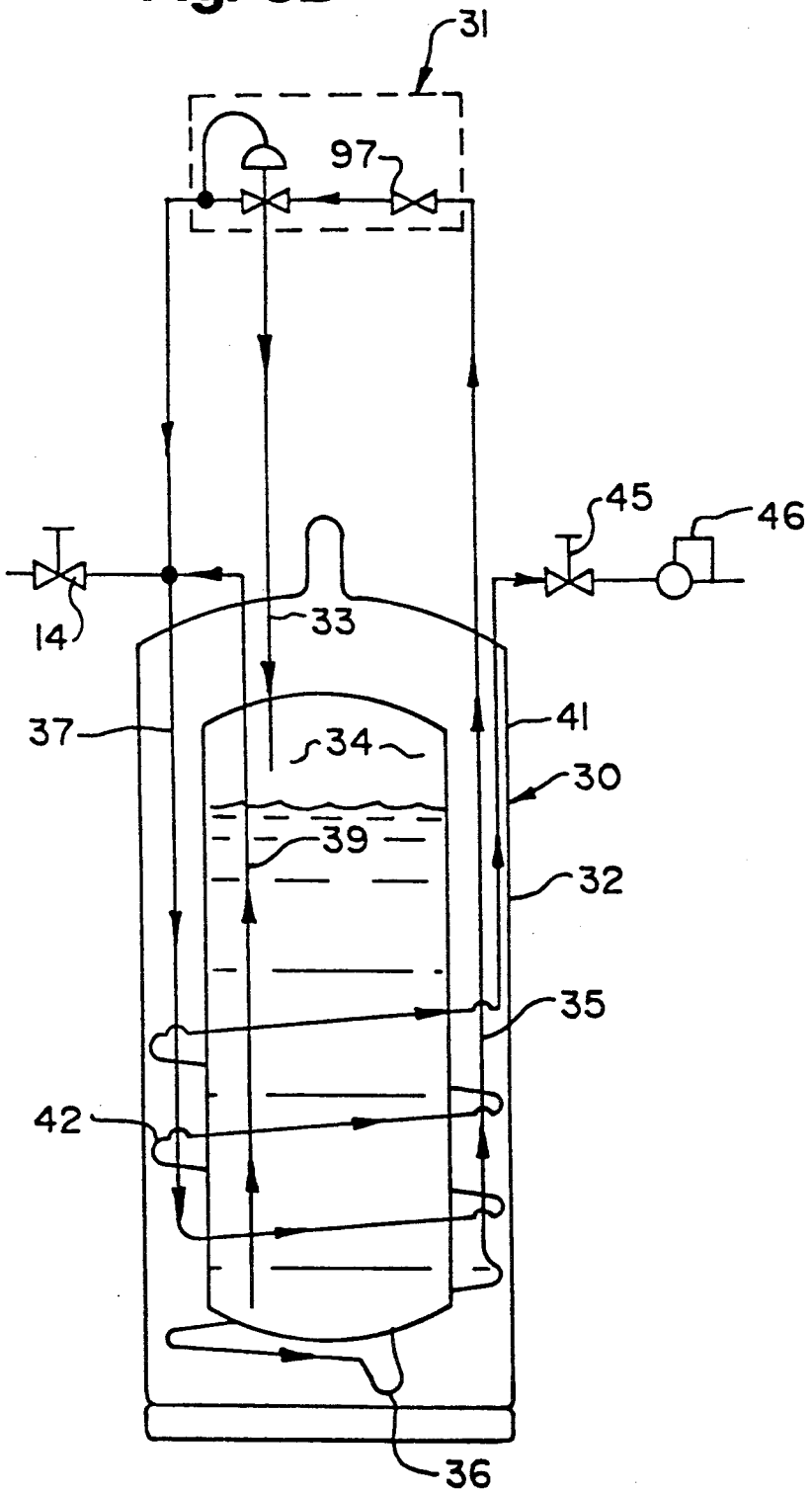
FIG. 3B is a schematic view of the delivery system of the invention showing the operation of the system delivery gas from the liquid body.

FIGS. 3A and 3B shows a schematic view of the cryogenic delivery system of the invention including a double-walled storage vessel 30 having an internal tank 32. The dual-function regulator of the invention is shown generally at 31. A pressure builder line 35 connects pressure building coil 36 to the pressure builder inlet of regulator 31. Pressure building coil 36 is connected to the bottom of tank 32 to convert the liquid to gas as previously described with respect to the prior art device. A vaporizer line 37 connects the economizer outlet of regulator 31 to the vaporizer 42 which is, in turn connected to gas use line 41. Dip tube 39 is connected to vaporizer line 37 and can be accessed externally at liquid fill valve 14 to replenish the supply of liquid oxygen in tank 30. A gas use valve 45 is provided in gas use line 41 to control to delivery of gas from the system. Economizer line 33 opens to the gas head 34 inside tank 30 and is connected to the pressure builder inlet/economizer outlet of regulator 31.

Figure 4:
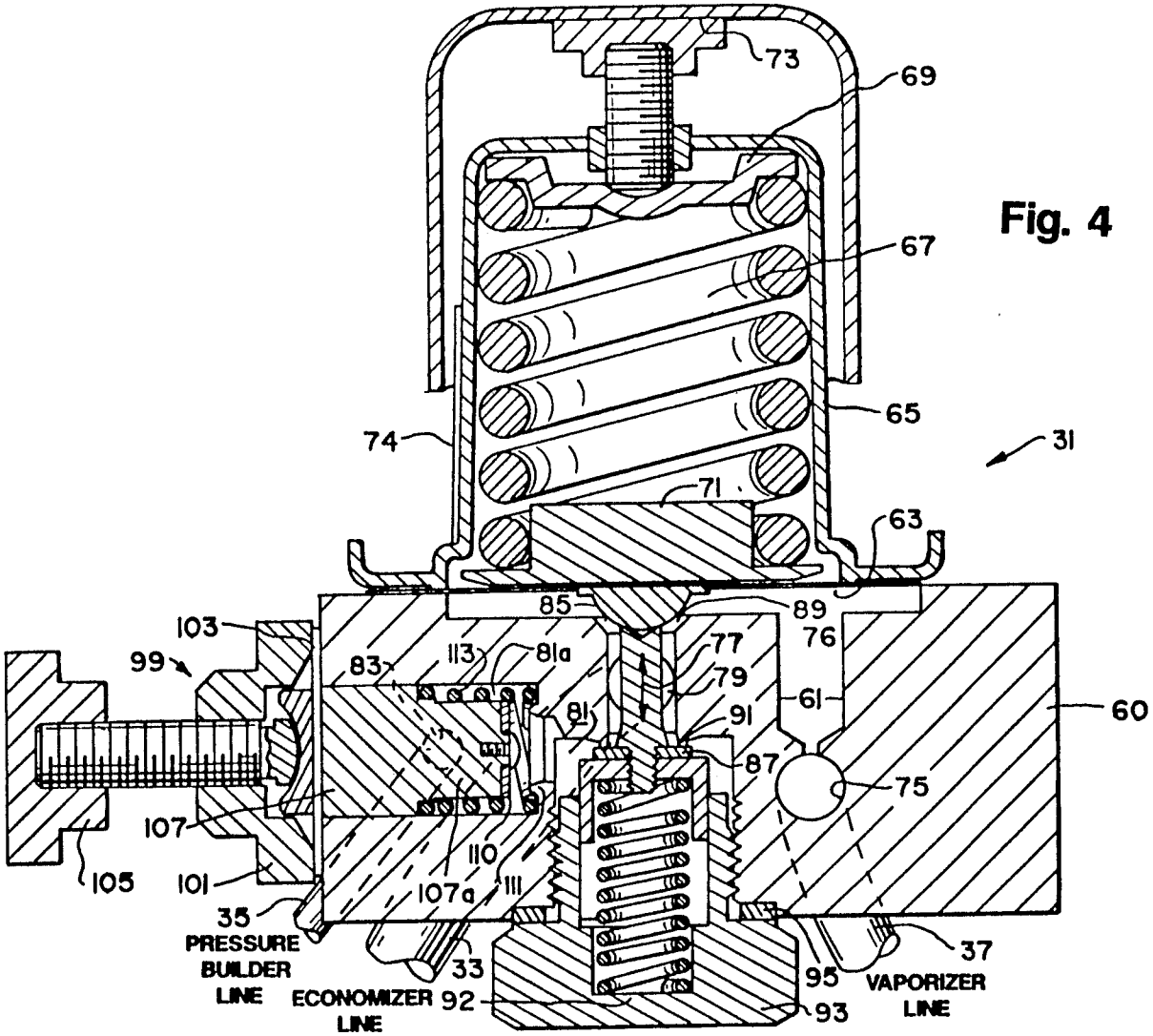
FIG. 4 is a section-view of the dual-function regulator of the invention.

Dual-function regulator 31 is shown in greater detail in FIG. 4 consisting of a body 60 having a first passage 61 formed therein. Passage 61 is isolated from the external environment by flexible diaphragm 63. A housing 65 is fixed to body 60 so as to be coextensive with diaphragm 63. A calibrated compression spring 67 is located within housing 65 and is compressed between first pressure plate 69 and second pressure plate 71 such that a downward force (as viewed in FIG. 4) is exerted on diaphragm 63 substantially uniformly over its entire surface. Pressure plate 69 is engaged by threaded member 73 which cooperates with screwthreads formed on housing 65 whereby rotation of member 73 varies the force exerted on diaphragm 63 by pressure plate 71. Because spring 67 is designed for a specified range, rotation of member 73 in conjunction with a calibrated label 74 permits selecting a precise pressure setting. Thus, calibration is simple compared to the prior art, which requires removal of the regulator from the delivery system and the use of an independent pressure source and gauge to set the desired pressure.

Figure 1:
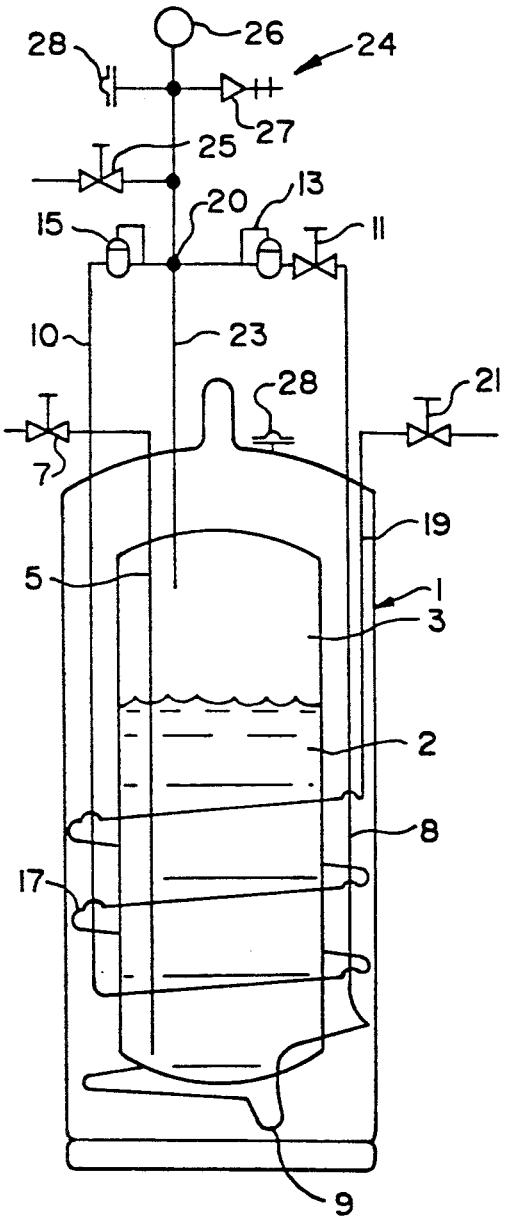
Fig. 1 PRIOR ART
FIG. 1 is a schematic view of a prior art cryogenic vessel delivery system.

Passage 61 communicates with an economizer outlet port 75 which is connected to vaporizer line 37 as described in reference to FIG. 3. Passage 61 also communicates with a valve passage 76 which receives a reciprocating valve member 77. Valve passage 76 communicates at a midpoint with pressure builder outlet/economizer inlet port 79 which is connected to economizer line 33 as described with particular reference to FIG. 1.

The opposite end of valve passage 76 is connected to a second passage 81 which communicates with pressure builder inlet port 83. Pressure builder inlet 83 is connected to pressure building line 35 as described with particular reference to FIG. 1.

Valve member 77 can reciprocate in valve passage 76 and includes an economizer seat 85 and a pressure builder seat 87. Economizer seat 85 cooperates with bevelled portion 89 of body 60 to isolate passage 61 from pressure builder outlet/economizer inlet 79 while allowing communication between pressure builder inlet 83 and pressure builder outlet/economizer inlet 79. Similarly, pressure builder seat 87 cooperates with an annular lip 91 formed on body 60 to isolate pressure builder inlet 83 from pressure builder outlet/economizer inlet 79 while allowing communication between the economizer outlet 75 and pressure builder outlet/economizer inlet 79.

A compression spring 92 is provided to maintain contact between valve member 77 and diaphragm 63 such that movement of diaphragm 63 results in the simultaneous movement of valve member 77. A cap member 93 screwthreadably engages body 60 such that it can be removed to allow access to spring 92 and valve member 77. Suitable seals 95 are provided to ensure a fluid-tight seal.

A manual pressure building valve 99 is located in second passage 81 and is provided to isolate the pressure builder circuit at tank pressures below set pressure of spring 67. This is desirable when filling the container. Valve 99 consists of a first member 101 secured to body 60 with a flexible diaphragm 103 disposed therebetween. A handle 105 screwthreadably engages member 101 such that when handle 105 is rotated in a first direction it will deform diaphragm 103. A sliding block 107 is located opposite diaphragm 103 such that the deformation of diaphragm 103 causes block 107 to slide in passage 81. Block 107 includes a portion 107*a* having a diameter less than that of passage 81 such that an annular cavity 81*a* is formed whereby port 83 can communicate with passage 81. Block 107 has a seal 110 located at the end thereof engageable with annular valve seat 111 such that pressure builder inlet can be isolated from the rest of regulator 31. A compression spring 113 is provided to move block 107 leftward as viewed in FIG. 4 when handle 105 is rotated in a second direction.

The operation of the regulator of the invention will be described with particular reference to FIGS. 3 and 4. The compressive force exerted by spring 67 on diaphragm 63 can be controlled by member 69 by simply turning member 73. The force exerted by the spring is calibrated prior to assembly to correlate to the pressure in the system and the calibration label 74 is properly located on element 65.

When the force exerted on diaphragm 63 by the pressure in the system is greater than the force exerted by spring 67 the regulator will assume the position shown in FIG. 4 and the system will operate to deliver gas as shown by the arrows in FIG. 3A. In this position economizer line 33 communicates with vaporizer line 37 via economizer outlet 75, passage 61 and pressure builder outlet/economizer inlet 79. Thus when the pressure in the system is equal to or above the predetermined pressure as set by spring 67, gas will be delivered from the gas head 34 through economizer line 33 and regulator 31 to the vaporizer 42 and into gas use line 41.

When the pressure in the system falls below the predetermined value, the force exerted on diaphragm 63 by spring 67 will be greater than that exerted by the system pressure such that valve 77 will be moved downwardly from the position shown in FIG. 4 until economizer seat 85 engages bevelled portion 89. The system will operate to deliver gas as shown by the arrows in FIG. 3B. In this position pressure building line 35 will be connected to economizer line 33 via passages 81 and 76, pressure builder inlet 83 and pressure builder outlet/economizer inlet 79. As a result, liquid oxygen will enter pressure building coil 36 (due to head pressure from the liquid), pass through pressure building line 35, regulator 31 and enter vessel 32 via economizer line 33 to build up the pressure of head 34. Simultaneously, the drop in pressure resulting from valve 45 being opened will force liquid 46 up through dip tube 39 and into vaporizer line 37. The liquid will enter vaporizer 42 and be delivered in a gaseous state to gas use line 41.

Figure 2:
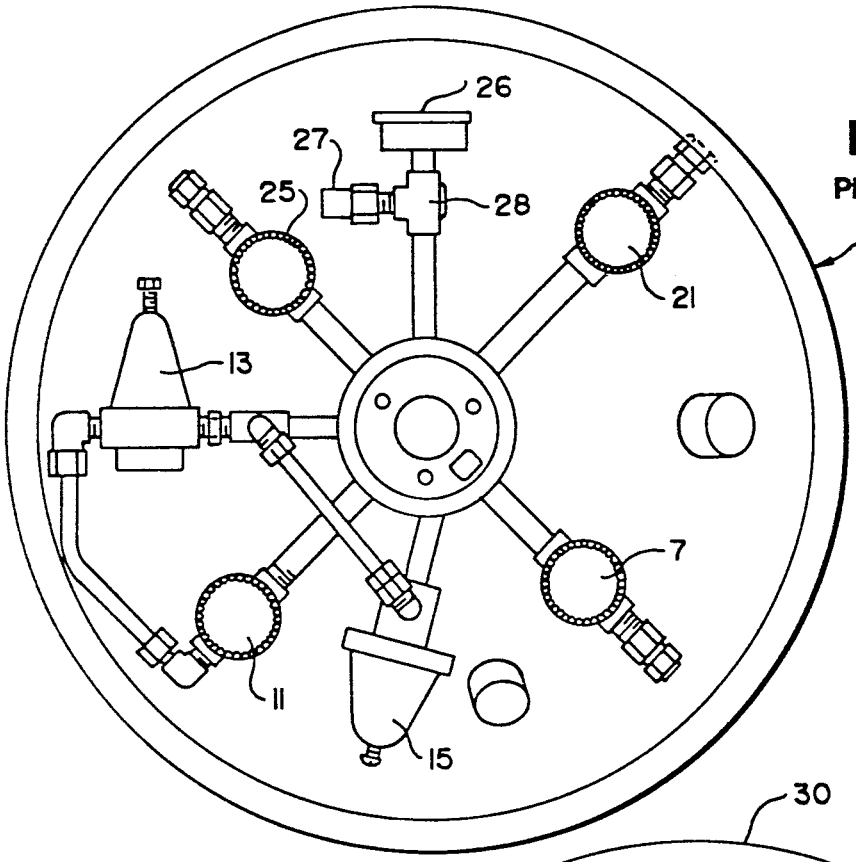
Fig. 2 PRIOR ART
FIG. 2 is a top view of a cryogenic vessel showing the prior art delivery system of FIG. 1.
Figure 5:
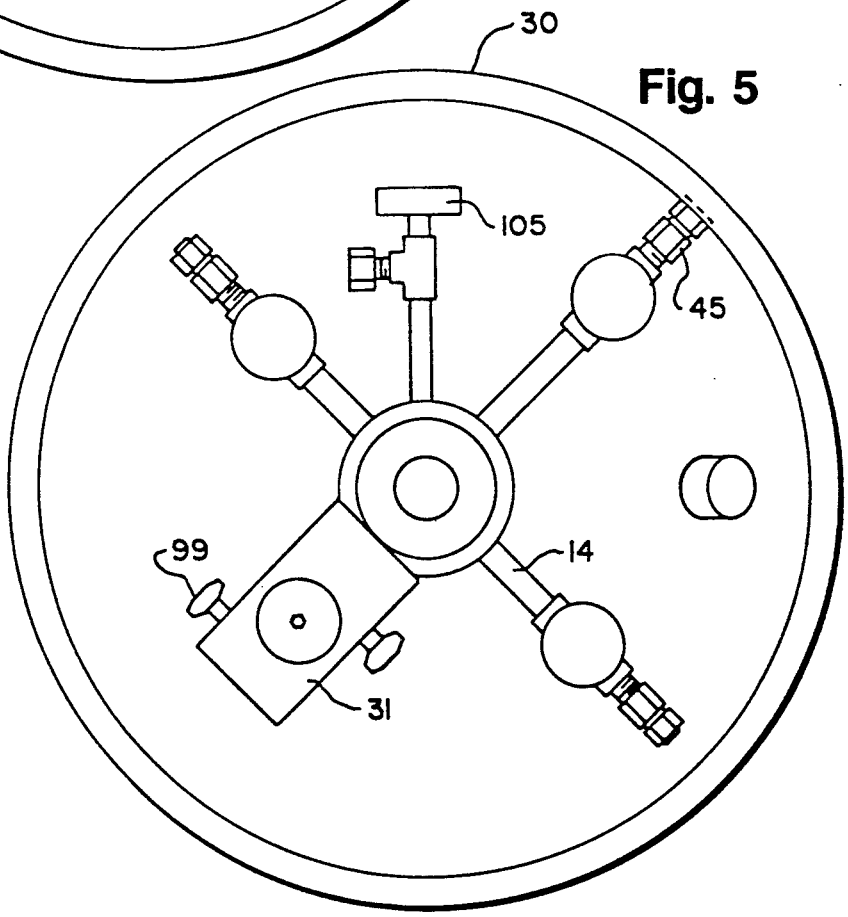
FIG. 5 is a top view of a cryogenic vessel showing the delivery system of the invention.

As is evident from the foregoing description of the invention, regulator 31 operates in response to the pressure in the system to selectively deliver oxygen from either the gas head 30 through economizer line 33 or from the liquid body 46 through dip tube 39. Thus the dual-function regulator of the invention eliminates the need for separate economizer and pressure building regulators and greatly simplifies the construction of the delivery system as is evidenced by a comparison of FIGS. 2 and 5.

While the invention has been shown and described in some detail, it will be understood that this description and the accompanying drawings are offered merely by way of example and that the invention is to be limited in scope only by the appended claims.

What is claimed is:

1. A control regulator for use in tanks containing a cryogenic fluid having a liquid body and a gas head, a dip tube for filling the tank extending into the liquid body, a pressure building line to connect the liquid body with the regulator, an economizer line to connect the gas head with the regulator and a vaporizer line to connect a gas use line to the regulator and to the dip tube, comprising:

a) a first port connected to the economizer line;
b) a second port connected to the vaporizer line;
c) a third port connected to the pressure building line; and
d) valve means selectively movable between a first position where said first port communicates with said second port and cryogenic fluid is delivered to the gas use line from the gas head via the economizer line and a second position where the first port is in communication with said third port and the cryogenic fluid is delivered to the gas use line from the liquid body via the dip tube while pressure of the gas head is rebuilt via the pressure building line and economizer line, said valve means being movable to said first position when the pressure in the tank rises above a predetermined maximum.

2. The control regulator according to claim 1, wherein said valve means is selectively moved in response to the pressure in the system.

3. The control regulator according to claim 2, wherein the movement of said valve means is controlled by a biasing means calibrated to correlate to the head pressure in the system.

4. The control regulator according to claim 3, wherein the pressure exerted by the biasing means on said valve means can be varied.

5. The control regulator according to claim 1, further including means for isolating said third port and said pressure builder line from both of said first and second ports whereby pressure in the system can be isolated during the fill up of the tank.

6. A cryogenic fluid delivery system, comprising:

a) an insulated storage tank containing a liquid body and a gas head;
b) a dip tube communicating the exterior of the tank with the interior of the tank to allow delivery of liquid to the tank;
c) a gas use line for delivering gas to a use device;
d) a regulator for controlling the delivery of cryogenic fluid to the gas use line;
e) an economizer line connecting the gas head with a first port of the regulator;
f) a vaporizer line connecting the gas use line with a second port of the regulator and with the dip tube;
g) a pressure building line connecting the liquid body with a third port of the regulator; and
h) said regulator including means for selectively delivering fluid from either the gas head or the liquid body to the gas use line in response to the pressure in the system.

7. The cryogenic fluid delivery system according to claim 6, wherein said means for selectively delivering fluid includes a valve means selectively movable between a first position where said economizer line is in communication with said vaporizer line and gas is delivered for use from the gas head via the economizer line and a second position where said economizer line is in communication with said pressure builder line and gas is delivered for use from the liquid body via the dip tube.

8. The cryogenic fluid delivery system according to claim 6, wherein said regulator includes means for controlling the pressure at which said means for selectively delivering fluid from either the gas head or liquid body operates.

9. The cryogenic fluid delivering system according to claim 8, wherein said means for controlling the pressure at which said means for delivering fluid operates is calibrated such that the pressure can be changed.

10. A cryogenic liquid delivery system, comprising:

a) an insulated storage tank containing a liquid body and a gas head;
b) a regulator for controlling the delivery of fluid from said storage tank to a gas use device;
c) a gas use line for delivering as to the gas use device;

d) an economizer line connecting the gas head with a first port of the regulator;

e) a vaporizer line connecting the gas use line with a second port of the regulator;

f) a dip tube connecting the liquid body to the vaporizer line;

g) a pressure building line connecting the liquid body with a third port of the regulator; and h) said regulator including a valve means movable between a first position where the economizer line communicates with said vaporizer line and said third port is closed and gas is delivered to the gas use line from the gas head and a second position where the economizer line communicates with the pressure building line and the second port is closed and gas is delivered to the use line from the liquid body through the dip tube and the vaporizer line and the pressure in the tank is rebuilt through the pressure building line and the economizer line.

11. The delivery system according to claim 10, further including means for moving said valve means to the first position when the pressure in said tank exceeds a predetermined value.

12. The delivery system according to claim 11, wherein said means for moving includes a member exposed to the gas in said economizer line.

13. The delivery system according to claim 12, wherein said member is a diaphragm.

14. The delivery system according to claim 11, further including means for changing the predetermined value.

15. The delivery system according to claim 10, further including means for isolating the pressure building line during the filling of the tank.

* * * * *

US005136852A

REEXAMINATION CERTIFICATE (2308th)

United States Patent [19]

[11] B1 5,136,852

Neeser et al.

[45] Certificate Issued May 31, 1994

[54] CONTROL REGULATOR AND DELIVERY SYSTEM FOR A CRYOGENIC VESSEL

[75] Inventors: Timothy A. Neeser, Savage; Peter L. Bliss, Prior Lake, both of Minn.

[73] Assignee: Minnesota Valley Engineering, Inc.

Reexamination Request:
No. 90/003,041, Apr. 30, 1993

Reexamination Certificate for:

| | |
|---|---|
| Patent No.: | 5,136,852 |
| Issued: | Aug. 11, 1992 |
| Appl. No.: | 683,267 |
| Filed: | Apr. 10, 1991 |

[51] Int. Cl.[5] ..... F17C 9/04
[52] U.S. Cl. ..... 62/50.4; 62/51.1
[58] Field of Search ..... 62/50.4, 51.1

[56] References Cited

U.S. PATENT DOCUMENTS 3,001,375 9/1961 Tauscher .

FOREIGN PATENT DOCUMENTS 2443679 7/1975 Fed. Rep. of Germany .

OTHER PUBLICATIONS

English Translation of Document "L", above, provided by Reexam Requester, 9 pages.

*Primary Examiner*—Ronald C. Capossela

[57] ABSTRACT

The regulator of the invention includes a pressure builder inlet, economizer outlet and a pressure builder outlet/economizer inlet. A valve is moved in response to the pressure of the gas head in the tank to connect the pressure builder outlet/economizer inlet with either the pressure builder inlet or economizer outlet. As a result, the single dual-function regulator of the invention allows gas to be delivered from either the gas head or the liquid body as determined by the pressure of the gas head. A manual pressure build up valve is provided to allow isolation of the pressure build up system.

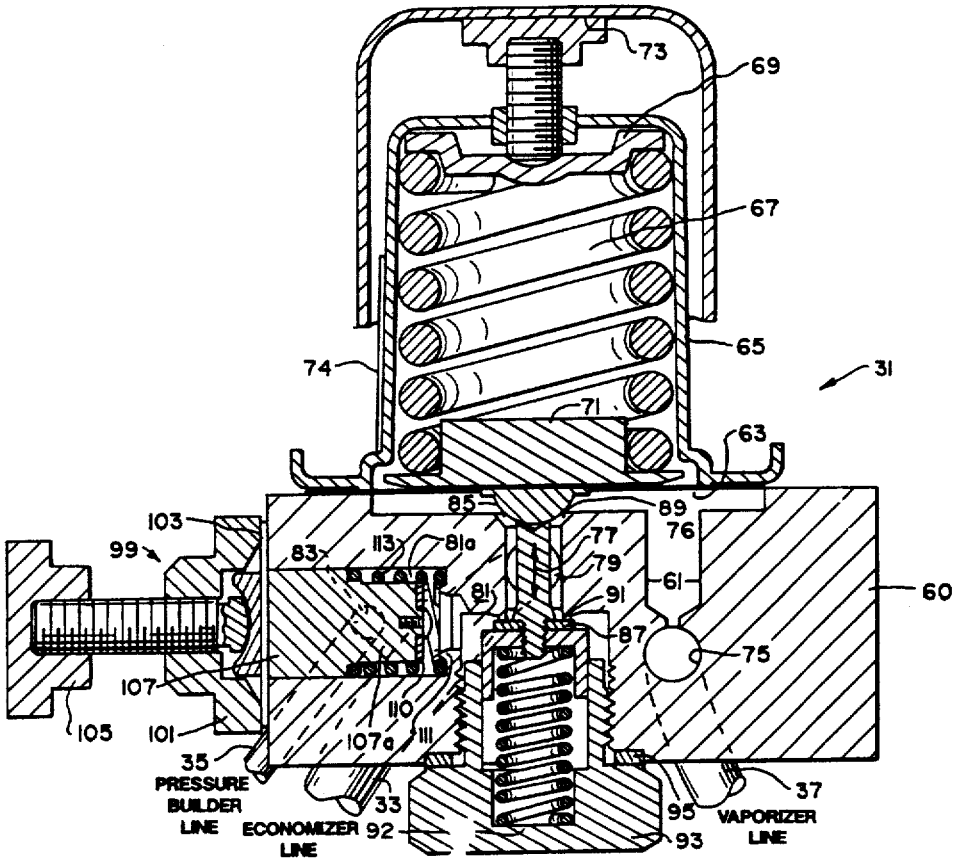

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–15 are cancelled.

New claim 16 is added and determined to be patentable.

*16. A cryogenic liquid delivery system, comprising:*

*a) an insulated storage tank containing a liquid body and a gas head;*

*b) a regulator for controlling the delivery of fluid from said storage tank to a gas use device;*

*c) a gas use line for delivering gas to a gas use device;*

*d) an economizer line connecting the gas head with a first port of the regulator;*

*e) a vaporizer line connecting the gas use line with a second port of the regulator;*

*f) a dip tube connecting the liquid body to the vaporizer line;*

*g) a pressure building line connecting the liquid body with a third port of the regulator;*

*g) said regulator including a valve means movable between a first portion where the economizer line communicates with the vaporizer line and said third port is closed and gas is delivered to the gas use line for the gas head and a second position where the economizer line communicates with the pressure building line and the second port is closed and gas is delivered to the use line from the liquid body through the dip tube and the vaporizer line and the pressure in the tank is rebuilt through the pressure building line and the economizer line;*

*i) said valve means including a member exposed to the gas in said economizer line for moving the valve means to the first position when the pressure in the tank exceeds a predetermined value; and*

*g) means for isolating said third port and said pressure builder line from both of said first and second ports, said means for isolating including a member located in said regulator that is manually movable to a position where fluid cannot flow through said regulator to said third port from either said first or second ports.*

* * * * *